US007028744B2

(12) United States Patent
Jiang et al.

(10) Patent No.: US 7,028,744 B2
(45) Date of Patent: Apr. 18, 2006

(54) SURFACE MODIFICATION OF CASTINGS

(75) Inventors: Jiaren Jiang, London (CA); Xing Yang Liu, London (CA)

(73) Assignee: National Research Council of Canada, Ottawa (CA)

( * ) Notice: Subject to any disclaimer, the term of this patent is extended or adjusted under 35 U.S.C. 154(b) by 86 days.

(21) Appl. No.: 10/801,818

(22) Filed: Mar. 17, 2004

(65) Prior Publication Data

US 2005/0205229 A1 Sep. 22, 2005

(51) Int. Cl.
*B22D 27/00* (2006.01)

(52) U.S. Cl. ..... 164/72; 164/98

(58) Field of Classification Search ..... 164/72, 164/267, 98

See application file for complete search history.

(56) References Cited

U.S. PATENT DOCUMENTS

| | | | | |
|---|---|---|---|---|
| 5,620,754 | A * | 4/1997 | Turchan et al. | 427/554 |
| 6,478,831 | B1 * | 11/2002 | Tselesin | 51/293 |
| 6,506,326 | B1 * | 1/2003 | Abbott et al. | 264/104 |

FOREIGN PATENT DOCUMENTS

| | | |
|---|---|---|
| JP | 53125236 | * 11/1978 |
| JP | 55030305 | 3/1980 |
| JP | 55077957 | 6/1980 |
| JP | 57036037 | 2/1982 |
| JP | 57062851 | 4/1982 |
| JP | 58110139 | 6/1983 |
| JP | 2108447 | 4/1990 |
| JP | 6254667 | 9/1994 |
| JP | 10137917 | 5/1998 |

* cited by examiner

*Primary Examiner*—Kevin Kerns
*Assistant Examiner*—I.-H. Lin
(74) *Attorney, Agent, or Firm*—Anissimoff & Associates; Hans Koenig

(57) ABSTRACT

A method of modifying a surface of a casting involves providing a casting mould; placing a perforated mask with the mould to define a masked area of the mould; spray-coating the masked area of the mould with a coating material selected for forming a surface layer on the casting; introducing a liquid casting material to the mould; and, solidifying the liquid casting material to form a surface modified casting. The present method reduces the tendency for the coating material to spall from the mould and permits the formation of thicker coating layers on the mould. Thicker and better quality surface layers may be formed on castings.

24 Claims, 7 Drawing Sheets

SURFACE MODIFICATION OF CASTINGS

FIELD OF THE INVENTION

The present invention relates to methods of modifying surfaces of castings and to castings produced by casting processes. In particular, the present invention relates to spray-coating a casting mould and forming castings having modified surfaces using the spray-coated casting mould.

BACKGROUND OF THE INVENTION

Engineering components generally fail in one or a combination of three basic modes: corrosion, wear and fracture. The requirements for material properties to combat each of these modes are different and often conflicting. In many cases, a monolithic bulk material can only provide a good compromise to satisfy the differing and conflicting requirements. One effective means of mitigating against damage, especially damage due to corrosion and wear, is to modify the composition and/or microstructure of the surface and/or near-surface region of the component to improve both mechanical properties and resistance to failure.

Among the many technologies available to treat the surface and/or near-surface of a component, surface modification during a casting process has many distinct advantages. Surface modification during casting generally permits formation of thick strengthening layers, choice of a wide assortment of materials, strengthening of specifically selected areas, application to large components or complicated shapes, reduction of overall process cost, and easy process implementation. However, using currently available casting surface modification techniques, the surface strengthening layers are prone to defects and it is difficult to achieve accurate dimensions and smooth surface finishes. Additionally, in some applications, thick alloying layers cannot be easily applied.

In the art, surface modification during casting is normally done by placing certain types of special material, which are normally powders or particles, in a casting mould at certain areas before casting. Examples of the special material include powders or particles of metals/alloys, oxides, nitrides, carbides, mixtures of ceramics with metals/alloys, mixtures of cermets with metals/alloys, mixtures thereof, etc. When a liquid casting material, e.g. molten metal, is cast into the mould and solidifies, a special strengthening layer is formed on the surface of the casting at a region corresponding to the area of the mould where the special material was placed. Methods of placing the special material in the casting mould can be generally divided into two categories: (1) methods that involve the use of a binder; and, (2) methods that do not use a binder.

Methods (1) of placing the special material in the casting mould that involve the use of a binder include, for example: (a) forming a paste by mixing the special material with an organic or inorganic binder and coating the paste on a surface of the casting mould where required; (b) mixing the special material with a binder, shaping the mixture into a pre-form, placing the pre-form in a certain area of the casting mould, and then casting with or without pressure; (c) pre-treating a pattern by coating it with a paste or enclosing powders in certain areas of the pattern before making the casting mould (lost pattern method); (d) applying a high temperature adhesive to the surface of the casting mould and then applying the special material to the adhesive. One of the most apparent problems with methods involving the use of a binder is that high heat used during the casting process causes binder decomposition leading to defects in the casting, for example inclusions and gas porosities.

Methods (2) of placing special material in the casting mould that do not involve the use of a binder include, for example: (a) enclosing the special material in a holding container having perforated openings and placing the container at required positions in the casting mould cavity; (b) placing ferromagnetic powders at a certain area of the casting mould and using magnetic forces or magnetic forces combined with vacuum to hold the ferromagnetic powders in position before and during casting; (c) applying loose powders/particles of the special material onto the surface of the casting mould and casting with applied pressure or under ambient pressure; (d) applying a layer of the special material on to required areas of the surface of the casting mould by spraying (e.g. thermal spraying); (e) applying a vacuum, with the help of a thin plastic film, to hold loose particles or powders of the special material on the surface of the casting mould before casting.

Methods that do not involve the use of a binder potentially allow for the production of better quality surface strengthening layers. However, there are some limitations on each of the aforementioned methods.

For example, in method (2)(a) where perforated containers are used, it is very difficult to form a localized strengthening layer following the exact surface profile of a casting. It is also very difficult to form thin strengthening layers. This method is suited mainly for forming thick strengthening layers in thick castings.

In method (2)(b), a magnetic field that generates a predetermined configuration following the profile of the casting surface is required in order to hold the special material. Thus, different configurations of the (electro-) magnets are required for different casting designs, which is impractical and costly to apply for the production of frequently changing casting designs. When the local profiles of the casting surface are complex, generating appropriate magnetic fields to hold the special material in the desired area and in uniform thickness becomes difficult. In addition, only ferromagnetic special materials can be used.

In method (2)(c), unless there is considerable difference in densities between the special material and the liquid casting material, loose particles can be engulfed in the flowing liquid casting material and swept away from the desired area. Therefore, the formation of a uniform strengthening layer on the casting surface becomes very difficult, if not impossible. It is also apparent that this method can only be applied to very simple, generally flat, casting surfaces on the bottom of the casting mould.

Method 2(d), which uses spray coating techniques, is perhaps the most versatile with respect to casting size, casting shape, choice of special material, uniformity of the coating layer, cleanliness of the coating layer. Spray techniques further permit better replication of the exact shape of the casting mould. Spray techniques are particularly useful when combined with precision casting processes to produce net shape castings, for example in fabricating high performance moulds and dies and in producing pump components. Localized strengthening on internal casting surfaces can be achieved by spray coating a ceramic/sand core followed by placing the core in the casting mould before casting. However, the major challenge for spray coating methods is to overcome the tendency for the coated layer to spall from the mould surface before casting. In addition, spray coating has traditionally provided coatings of only a very limited thickness, likely as a result of the spallation problem.

There remains a need in the art for a versatile method of modifying the surface or near surface of a casting, in particular a spray coating method which reduces the tendency of the coating layer to spall from a casting mould and which permits formation of thicker surface layers on the casting.

SUMMARY OF THE INVENTION

According to an aspect of the present invention, there is provided a method of modifying a surface of a casting, comprising: providing a casting mould; placing a perforated mask with the mould to define a masked area of the mould; spray-coating the masked area of the mould with a coating material selected for forming a surface layer on the casting; introducing a liquid casting material to the mould; and, solidifying the liquid casting material to form a surface modified casting.

There is also provided a casting with a modified surface produced according to a method of the present invention.

The method of the present invention preferably produces castings with modified surfaces at required regions by spray-coating a layer of desired coating material or materials on a casting mould surface and casting a liquid casting material into the mould to incorporate the layer of coating material with the casting.

The present invention may provide any one of or any combination of a number of surprising advantages. Spalling from the casting mould surface is reduced leading to more uniform layers. Coating layers on the mould may be formed which are thicker than those formed using conventional methods. Higher quality and thicker surface layers may be formed on casting surfaces. Castings may be formed with specially formed surfaces having fewer or no defects or inclusions, which significantly improves wear resistance, corrosion resistance, heat resistance or combinations thereof. Castings have improved metallurgical properties and surface quality.

Furthermore, there is very little restriction on the shape and size of the casting. Internal surfaces of castings can be strengthened by applying coatings to casting cores. Surface modifications to castings are applied during the casting process so that net or near-net shaped castings can be produced.

Any suitable casting mould may be used in a method of the present invention. A casting mould may be provided in any required or desired shape for use in a casting process to form a casting. The required or desired shape of the casting mould depends on the requirements of the casting so the casting mould is designed with casting requirements in mind. Casting moulds include both mould cavities and mould cores. Casting moulds may be fabricated of any suitable material. For example, casting moulds may be ceramic moulds, sand moulds, metallic moulds, or composite moulds made from a combination of materials. Ceramic moulds are typically used in precision casting and typically comprise inorganic ceramic binders. Sand moulds are used in typical sand casting methods. Choice of casting mould may depend on choice of casting material and/or choice of casting process.

Casting moulds may be pre-treated to alter the properties of the mould for better coating performance. Pre-treatment may be applied to mould cavities, mould cores, or both mould cavities and mould cores. Pre-treating mould cores is especially useful when coating layers are desired or required on internal casting surfaces. In one embodiment, the surface and/or subsurface region of the casting mould may be strengthened before spray-coating without affecting dimensional accuracy of the mould. In the case of a casting mould used in a solid ceramic mould casting or an investment casting process, strengthening may be accomplished, for example, by firing the casting mould at a temperature in a range of from about 650° C. to about 1200° C. for a period of 1 hour per inch (2.5 cm) thickness of the mould. Strengthening the casting mould permits application of thicker coatings on the surface of the mould, thereby permitting thicker modified surface layers on the casting.

The coating material is chosen according to the application requirements of the casting, which are well known to one skilled in the art. Examples of some suitable coating materials include Fe-based alloys (e.g. steels), Ni-based alloys (e.g. Ni—Cr—B—Si, etc.), Co-based alloys (e.g. Co—Cr—B—Si, etc.), oxides (e.g. $Al_2O_3$, $ZiO_2$, $Cr_2O_3$, $TiO_2$, etc.), nitrides (e.g. $Si_3N_4$, AlN, TiN, etc.), borides (e.g. $Mo_2B$, $TiB_2$, $NbB_2$, $ZiB_2$, etc.), carbides (e.g. WC, $Cr_3C_2$, VC, TiC, SiC, etc.), mixtures of ceramic with metals, mixtures of cermet with metals, and mixtures thereof. Types of steels include, for example, high alloy steels, high carbon steels, stainless steels, tool steels, etc. In this context, metals may be a pure metal, a metal alloy or a mixture of metals.

In order to improve bonding quality of the coating material to the casting, especially when the coating material has a melting point higher than the melting temperature of the liquid casting material (e.g. coating materials comprising ceramics), a thin intermediate bonding layer of a different coating material having a melting point lower than the melting temperature of the liquid casting material may be applied over a thicker layer of the coating material before casting. Alternatively or additionally, the high melting point coating material may be mixed with a lower melting point coating material before spray-coating. Self-fluxing powders are well suited for such applications. The coating material may be adhered to or alloyed with the surface of the casting to form a surface layer on the casting.

The mask is a thin sheet of material having perforations, for example a mesh or a perforated plate. Mask thickness and material properties are selected so that the mask is able to withstand the temperature at which spray-coating is conducted. For example, when steel is used, a suitable mask thickness is in a range of from about 0.2 mm to about 5 mm, preferably from about 0.5 mm to about 1.5 mm.

Perforations may be arranged randomly or in a regular pattern on the mask. Any shape, size and arrangement of the perforations on the mask may be used. In a preferred embodiment, the perforations are arranged such that a maximum opening ratio is obtained. The opening ratio is the ratio between the area of the perforation openings and the total area of the mask. A maximum opening ratio permits maximization of surface coverage of the casting mould by the coating material and reduces the chance of plugging the mask. Masks with a regular pattern of perforations are preferred, more preferably perforations are arranged in a regular grid pattern. Meshes are preferred.

As previously indicated, the perforations may be of any shape and size, provided the perforations permit passage of coating material during spray-coating. Some non-limiting examples of perforation shape are circular, elliptical (e.g. oval) and polygonal (e.g. square, rectangular, hexagonal). Regular shapes are preferred. Perforations may be of similar dimensions along all axes or they may be elongated along an axis. Preferably, perforations have a shortest axis measuring about 0.5 mm to about 20 mm, more preferably about 0.8 mm to about 10 mm. Perforated masks preferably have 2 to 20 openings per 2.5 cm, more preferably 4 to 10 openings per 2.5 cm. For wire meshes, wire thickness is preferably about 0.4 mm to about 2 mm, more preferably about 0.5 mm to about 1 mm. Desired dimensions may be easily determined by one skilled in the art for any arrangement and shape of perforations.

Elongated openings in a mesh may be obtained, for example, by aligning parallel wires or strips in a first direction and cross-linking the aligned wires or strips with a small number of wires or strips in a second direction, e.g. perpendicular to the first direction, to form a mesh having elongated openings. Elongated openings in a perforated plate may be obtained, for example, by stamping out holes in a plate with an appropriately shaped die.

The mask may be made of any material suitable for the coating process. Preferably, the mask is made from a material comprising a metal, a metal-coated plastic, a ceramic, carbon (e.g. carbon fiber), or like material. Metal is of particular note.

The perforated portion of the mask is shaped to approximate the shape of the casting mould corresponding to a portion of the casting to be coated. When placed with the casting mould; the mask defines an area of the mould, i.e. the masked area, which will receive the coating material. Preferably, there is a gap between the mask and the mould which depends on the thickness of the coating layer desired, on the thickness of the mask and on the spray-coating parameters. The gap is preferably relatively uniform throughout the masked area. Preferably, the gap between the mask and the mould is about 1 mm to about 15 mm, more preferably about 2 mm to about 6 mm.

Without being held to any particular mode of action, it is thought that the use of a perforated mask divides the spray-coating into smaller fragments for an initial coating. It is thought that internal stresses caused by shrinking of the coating layer are directly related to lateral dimensions of the coating layer and that the use of a perforated mask to form coating fragments significantly reduces the internal stresses and the tendency of the coating layer to spall from the casting mould surface. Reduction in the tendency of the coating layer to spall from the casting mould is thought to permit application of thicker coating layers to the mould surface, which results in thicker surface layers on the casting.

The mask may be placed with the casting mould in any suitable fashion. For example, the mask may be provided with an extra length of material that extends to the outside of the casting mould, whereby the extra length of material is used to support or fix the mask into position by, for example, clamping or weighing down the extra length of material.

After the mask is placed with the casting mould, the coating material is sprayed on to the masked area of the mould. Equipment and methods of spray-coating are selected according to coating material and application requirements, which are well known to one skilled in the art. Any suitable spray method may be used. Thermal spray techniques are preferred. Thermal spray techniques include, for example, flame spray, arc spray, plasma spray, explosion spray, etc. Spray temperatures depend on coating material and spray techniques, and the selection of appropriate spray conditions/parameters is well known to one skilled in the art. For example, flame spray techniques may be used when the melting point of the coating material is below about 2000° C., while plasma spray techniques may be used when the melting point of the coating material is higher (e.g. for ceramics and cermets).

Spraying of the coating material on to the casting mould may be accomplished in a single pass or in a plurality of passes. One of the advantages of the method of the present invention is that a large number of passes may be performed to build up very thick layers of coating material since the tendency of the coating material to spall from the mould is reduced. The number of spray passes for any given application may be easily determined by one skilled in the art and depends on the desired thickness of the coating layer, the type of spray process used and the type of coating material being sprayed. For example, for Ni-based self-fluxing alloys flame sprayed on to a solid ceramic mould, up to 40 spray passes may be performed.

Combinations of coating materials may be used in one coating layer, and/or coating layers may be built upon each other by applying different coating materials in subsequent passes during the spray-coating process. The application of different coating materials in subsequent passes permits formation of functionally graded castings.

The perforated mask may be removed from the casting mould after spray-coating is complete, or, in some circumstances the mask may be left with the mould to ultimately form part of the surface layer on the casting. The mask may be left with the mould when the mask material and the casting material are compatible and/or inclusion of the mask material in the casting process causes no detrimental effects or even improves the properties of the casting. For example, if the mask is made of stainless steel and the casting material is an iron-based alloy, the mask may be incorporated into the casting and may even provide some alloying strengthening to the casting. The incorporated mask may also provide extra composite strengthening if the mask is significantly stronger than the casting material, such as in the case of a steel mask in an aluminum casting.

After depositing a certain required or desired thickness of the coating material at a specified area of the casting mould using the perforated mask, a thin overlay of coating material can be further applied to the entire mould without the use of the mask, resulting in a coating layer having continuous coverage on the casting mould surface and convoluted morphology with low stress concentration. Such a structure further permits the formation of a thicker and more uniform coating layer. Minimum thickness of the overlay coating is determined by application requirements, while maximum thickness is controlled by stresses developed in the coating layer. Compared with conventional methods of applying a spray coating on a casting mould surface, the convoluted morphology of the coating layer helps relieve stresses in the coating layer, therefore, a thicker overlay coating may be applied in the present invention as compared to conventional methods.

Once the spray-coating process is finished, any remaining casting mould assembly may be completed. In some circumstances, spray-coating and mould assembly may occur alternately, with some areas of the mould being spray-coated followed by an assembly step and then followed by another spray-coating step. The number and order of spray-coating steps and assembly steps depends on specific casting design and the purposes to which the casting will be put.

Once assembly of the casting mould is complete, a liquid casting material is then introduced to the mould. Any suitable casting process may be used, for example, gravity casting, low-pressure casting, pressure casting, vacuum casting, investment casting, etc. The casting material is any material suitable in the casting process of choice. Conversely, the choice of casting material may dictate the choice of casting process. For example, the casting material may comprise a metal. Metals include, for example, pure metals, alloys and metal mixtures. A metal may be mixed with a particulate or fibrous reinforcement phase, such as those used in metal-matrix composite casting. Reinforcement phases may include, for example, metal oxides, carbides, borides, nitrides, carbon (e.g. graphite), glass, other metals/alloys, or a combination thereof. Of particular note as casting materials are Fe-based alloys, for example steels and cast iron.

The casting material is introduced to the casting mould in liquid form, for example in a molten phase. Casting parameters depend on the type of casting material and casting mould used, which are well known to one skilled in the art. After introducing the liquid casting material to the mould, the casting material is solidified, for example by cooling, to form a casting with a surface layer comprising the coating material that was originally sprayed on to the mould. After solidification, the casting is removed from the mould and cleaned. The casting comprises a modified surface layer. The casting may be formed with an alloyed or a composite surface. The surface layer is alloyed with or adhered to the casting material at the desired or required regions of the casting in accordance with performance requirements.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DETAILED DESCRIPTION

Figure 1:
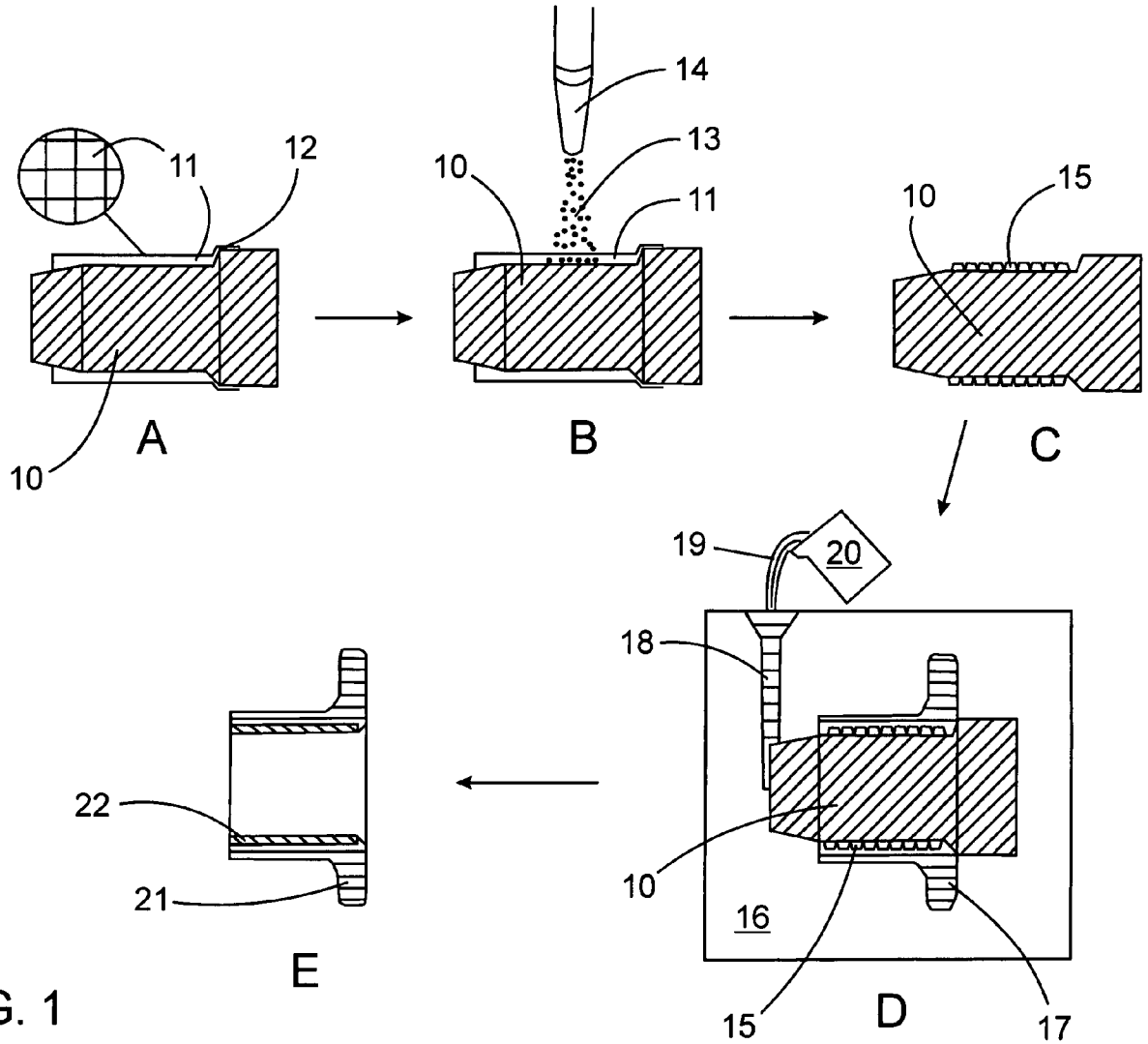
FIG. 1 is a schematic diagram of a method according to the present invention in which a mould core is coated with a coating material and a casting with a modified inner surface layer is subsequently produced.

Referring to FIG. 1, a method according to the present invention is schematically illustrated in which a mould core is coated with a coating material and a casting with a modified inner surface layer is subsequently produced. In step A, a pre-strengthened cylindrical ceramic mould core 10, shown in a cross-sectional side view, is provided with a cylindrical stainless steel wire mesh mask 11 spaced about 2 mm away from the mould core 10 around the core's circumference. The mask 11 has an extra length 12 secured to the mould core by a clamp (not shown). A close-up view of the surface of the mask 11 is shown in the balloon. In step B, a coating material 13 comprising Metco™ 15E (a self-fluxing nickel-based alloy powder) is sprayed through the mask 11 completely around the circumference of the mould core with a Sulzer Metco™ type 5P-II Thermospray gun 14 to form a circumferential coating layer on the surface of the mould core 10. The mask 11 is then removed. Step C shows the mould core 10 having a circumferential coating layer 15 of the coating material. The coating layer 15 is divided into smaller fragments as a result of spraying the coating material through the mask. In step D, a ceramic mould 16 is completed including the mould core 10 having the coating layer 15, a mould cavity 17 and a sprue 18. Molten steel 19 is poured from a melt cell 20 into the sprue 18 from where it enters and fills the mould cavity 17. The molten steel is allowed to cool and solidify, during which time it alloys with the coating layer 15 to form a hollow steel casting having an inner surface layer of Metco™ 15E. After cooling, the ceramic mould, including the mould core, is broken away from the steel casting. Step E shows the resulting hollow steel casting 21 having the surface layer 22 alloyed to the inside surface of the casting 21.

Figure 2:
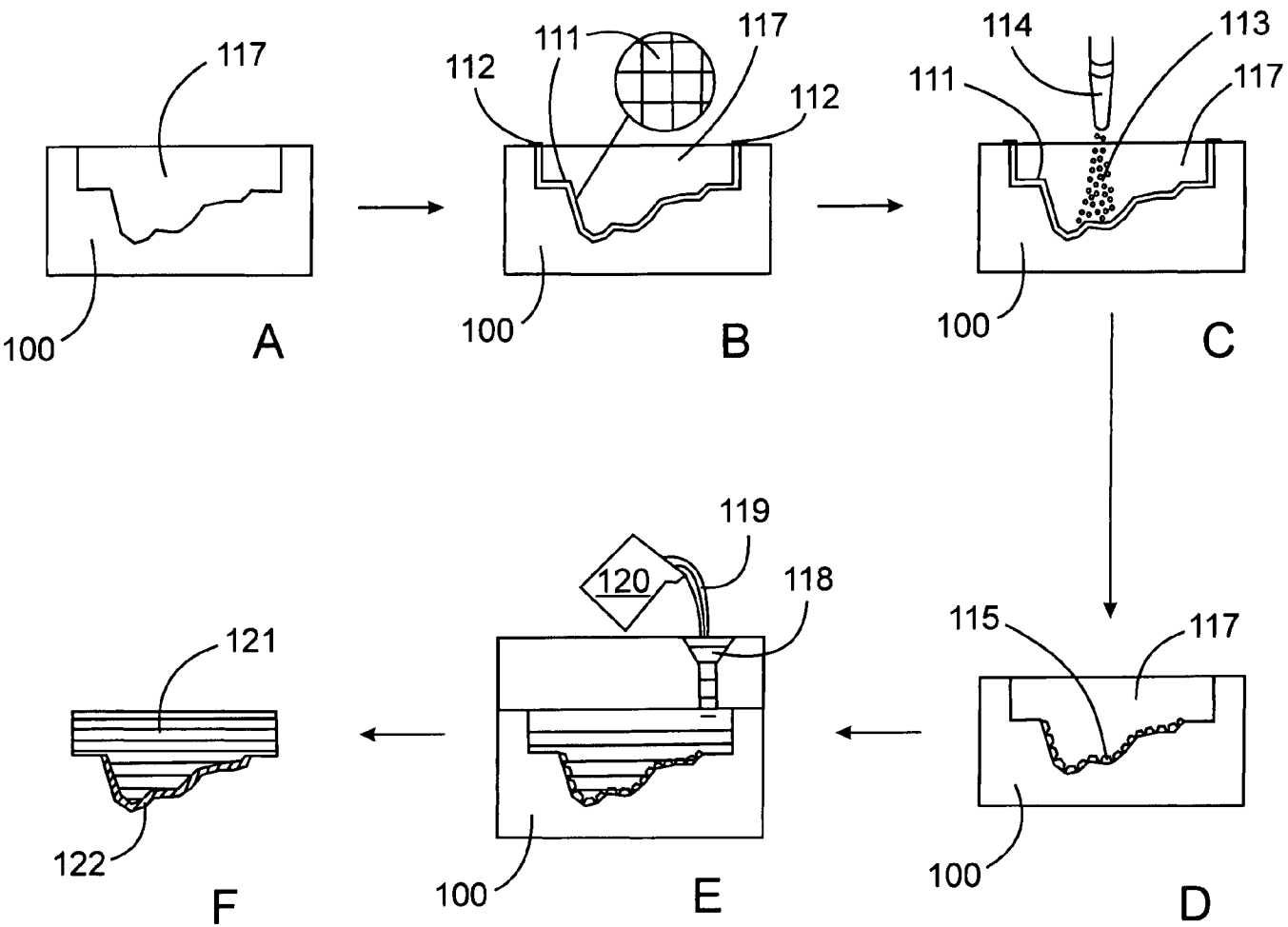
FIG. 2 is a schematic diagram of a method according to the present invention in which a mould cavity is coated with a coating material and a casting with a modified outer surface layer is subsequently produced.

Referring to FIG. 2, a method according to the present invention is schematically illustrated in which a mould cavity is coated with a coating material and a casting with a modified outer surface layer is subsequently produced. In step A, a pre-strengthened ceramic mould 100 with a mould cavity 117, shown in a cross-sectional side view, is provided. In step B, a steel wire mesh mask 111 is inserted into the mould cavity 117 so that it follows the contour of the mould's surface in the mould cavity. The mask 111 is spaced about 4 mm away from the surface of the mould 100 in the cavity 117. The mask 111 has an extra length 112 secured to the mould 100 by clamps (not shown). A close-up view of the surface of the mask 111 is shown in the balloon. In step C, a coating material 113 comprising a self-fluxing iron-based alloy powder is thermally sprayed with a spray gun 114 through the mask 111 to cover the surface of the mould 100 in the mould cavity 117. The mask 111 is then removed. Step D shows the mould 100 having a coating layer 115 of the coating material. The coating layer 115 is divided into smaller fragments as a result of spraying the coating material through the mask. In step E, the ceramic mould 100 is completed including the mould cavity 117 and a sprue 118. Molten steel 119 is poured from a melt cell 120 into the sprue 118 from where it enters and fills the mould cavity 117. The molten steel is allowed to cool and solidify, during which time it alloys with the coating layer 115 to form a steel casting having a surface layer of the iron-based alloy. After cooling, the ceramic mould is broken away from the steel casting. Step F shows the resulting steel casting 121 modified by the surface layer 122.

EXAMPLE 1

Figure 3A:
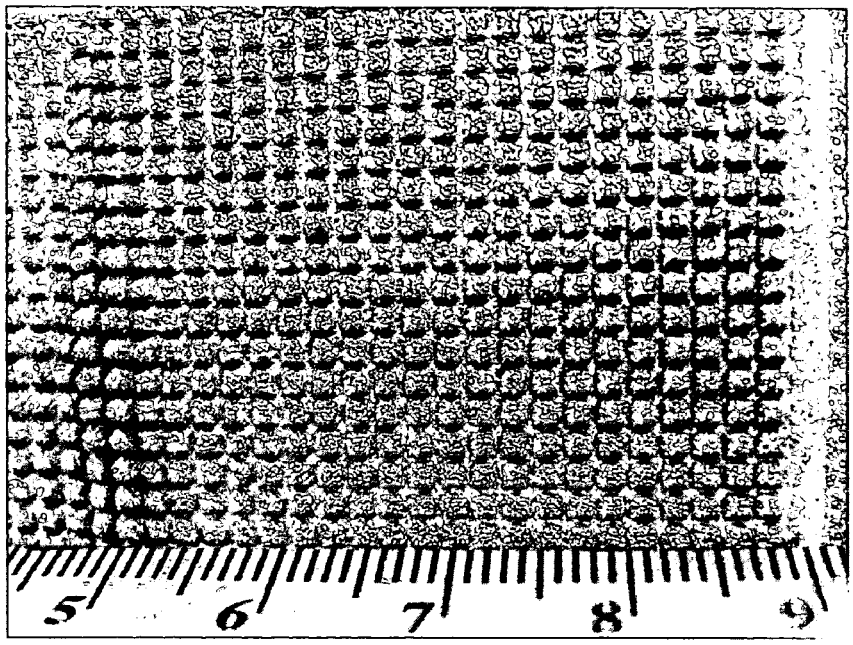
FIG. 3A is a photograph of a coating layer on a ceramic casting mould surface, coated by a method in accordance with the present invention.
Figure 3B:
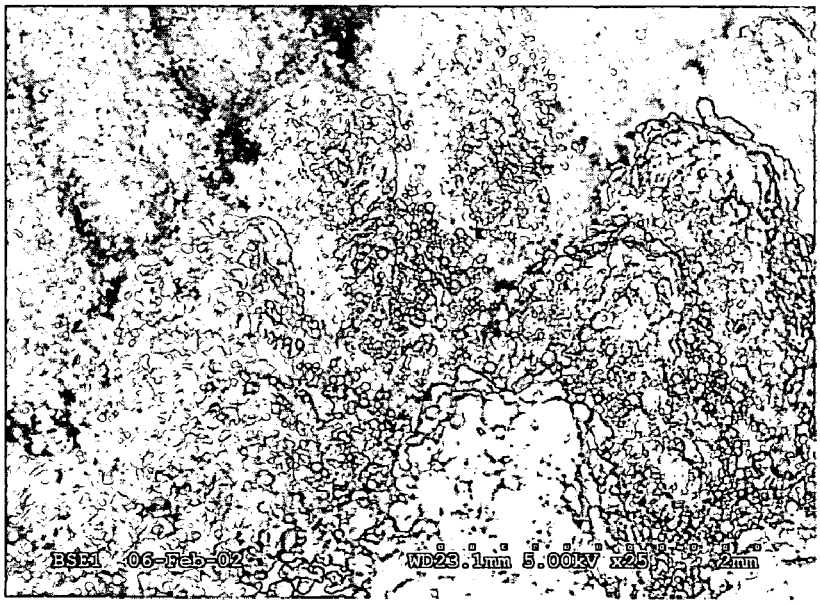
FIG. 3B is a scanning electron micrograph of the coating layer of FIG. 3A.

A ceramic casting mould having a mould cavity was fabricated according to a process similar to the Unicast process (R. E. Greenwood, "Ceramic Moulding by the Unicast Process", ASTME Tech. Paper No. CM67-534 (1967), the disclosure of which is herein incorporated by reference) and was fired at 950° C. for 4 hours to strengthen the mould. A perforated mask made of steel mesh (14 mesh with a wire diameter of 0.016 inch) was placed about 2 mm away from the mould cavity surface by clamping an extended portion of the mask to the mould surface surrounding the opening in the mould cavity. Using a Sulzer Metco™ type 5P-II Thermospray gun, a coating material consisting of Metco™ 15E (a self-fluxing nickel-based alloy powder having a composition of Ni: 70.5%, Cr: 17.0%, Fe: 4.0%, Si: 4.0%, B: 3.5%, C: 1.0% and a melting point of 1024° C.) was sprayed through the mask on to the mould cavity surface. To build up a thick coating layer, the spray was repeated 32 times without any sign of spallation (separation) of the coating layer from the mould cavity surface. The coating layer formed was about 1.7 mm thick. FIG. 3A shows the coating layer coated under these conditions. FIG. 3B is a scanning electron micrograph of the coating layer shown in FIG. 3A. It is clear from FIGS. 3A and 3B that spallation of the coating layer was not a problem.

Figure 4:
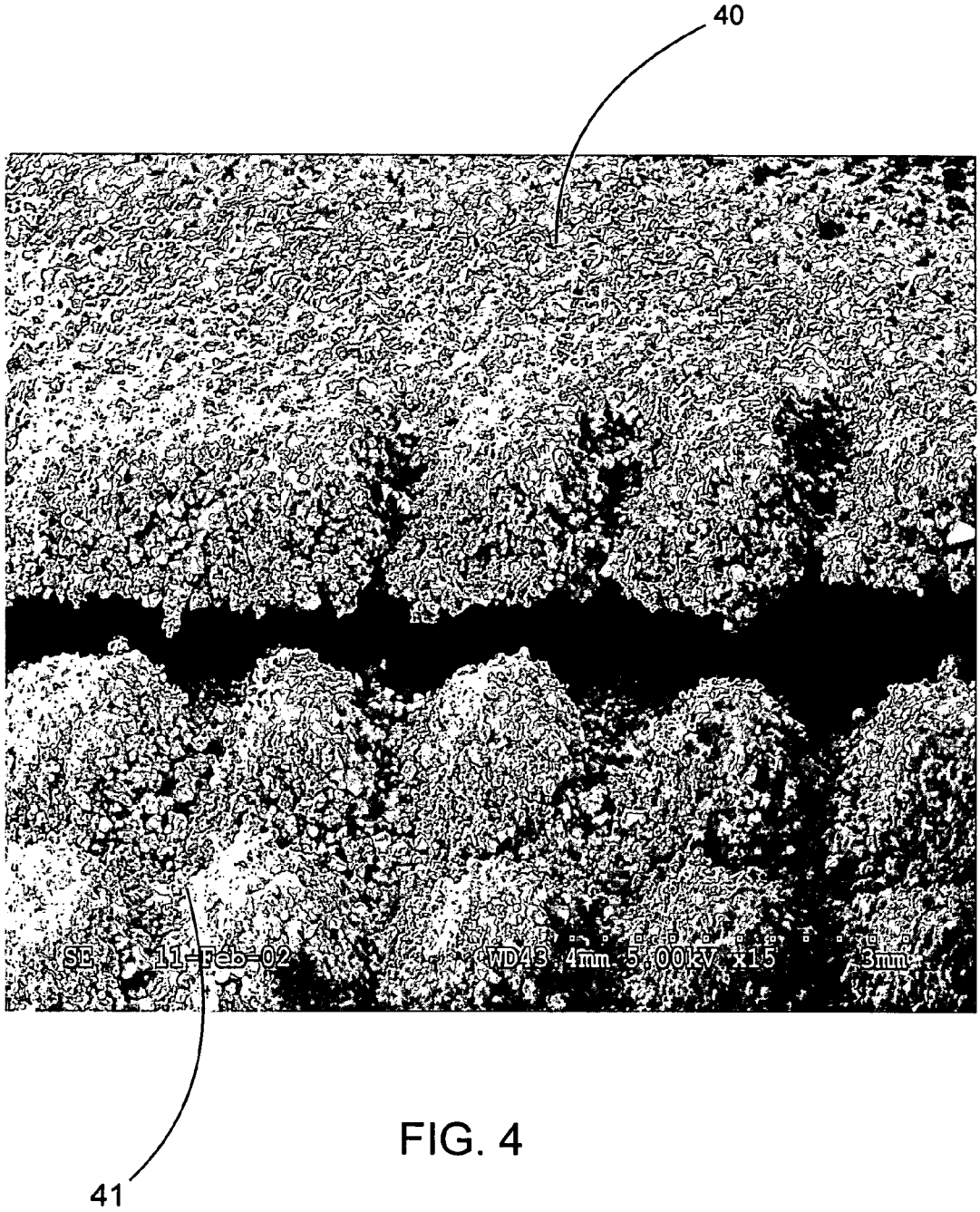
FIG. 4 is a scanning electron micrograph of two separate coating layers on a ceramic casting mould surface, one layer coated by a method of the present invention and the other layer coated by a method in accordance with the prior art.

Referring to FIG. 4, for comparison, a second spray coating was conducted under the same conditions as above, except that half of the mould cavity surface was left unmasked. In the unmasked half, spallation of the coating layer from the mould cavity surface near the coating edges was observed after the first pass. After 20 spray passes, a significant amount of spallation of the coating layer in the unmasked half 40 was noticed. The maximum separation was about 1.9 mm from the mould cavity surface. In contrast, the coating layer in the masked half 41 did not show any spallation and could be built up further without any indication of spallation (separation).

EXAMPLE 2

Figure 5:
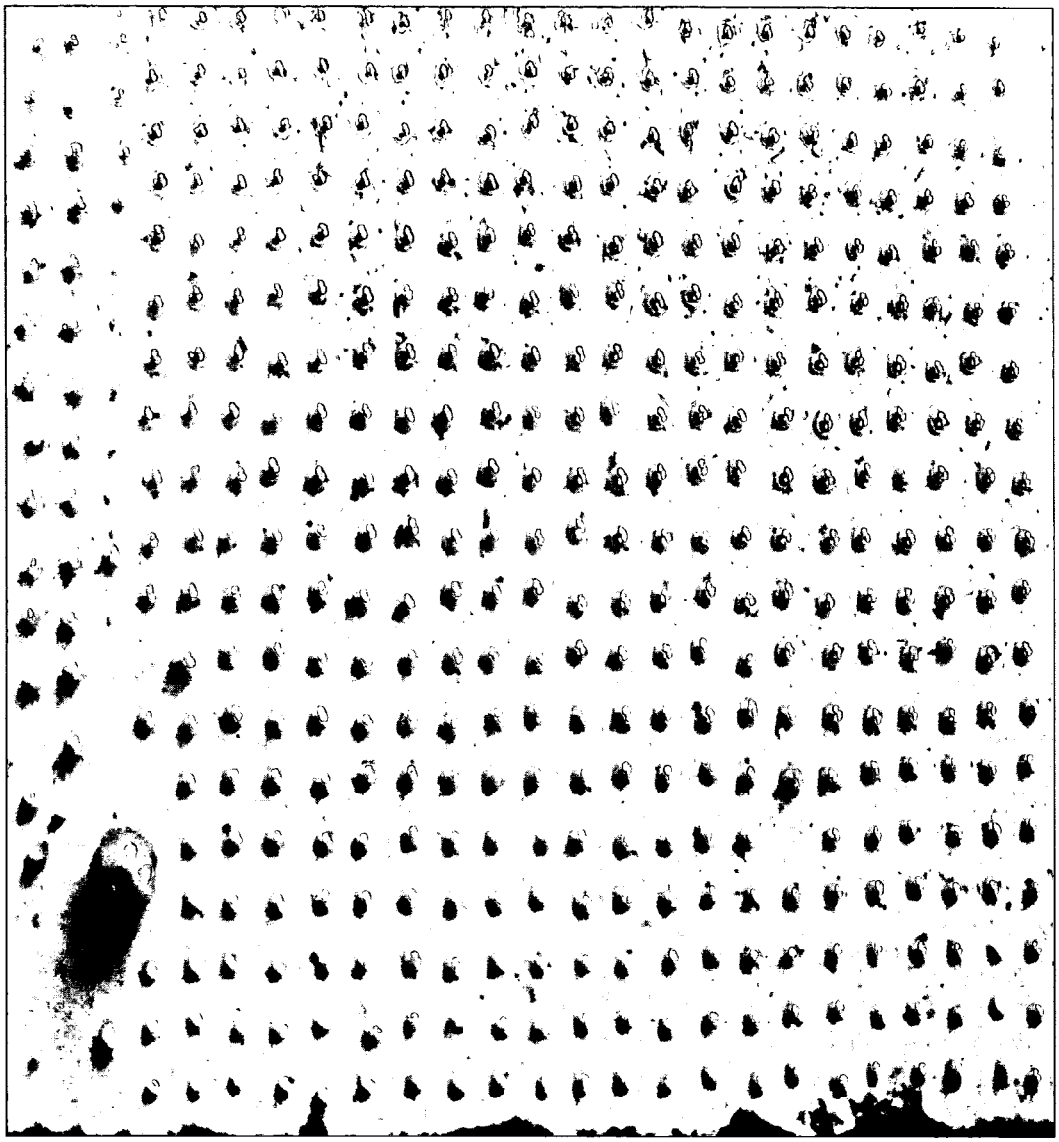
FIG. 5 is a photograph of a coating layer on a ceramic casting mould surface, coated by a method in accordance with the present invention, after heating to 1100° C. under reduced pressure.

A coating layer on a vertical surface of a ceramic casting mould was produced in accordance with the procedure of Example 1 except that some areas of the mould surface were left unmasked. The coating layer was heated under reduced pressure ($8\times10^{-2}$ Torr) to 1100° C., which is above the melting point of the Metco™ 15E, in 50 minutes and held for 2 hours. The coating layer was melted but still remained on the mould surface in the areas where the mask was used, as shown in FIG. 5. The coating thickness before heating to 1100° C. was 0.8 mm. However, in the areas where no mask was used, the coating layer completely spalled during the heating process, presumably due to high thermal stresses in the coating layer as a result of the large difference in thermal expansion coefficient between the coating layer and the ceramic casting mould.

EXAMPLE 3

Figure 6:
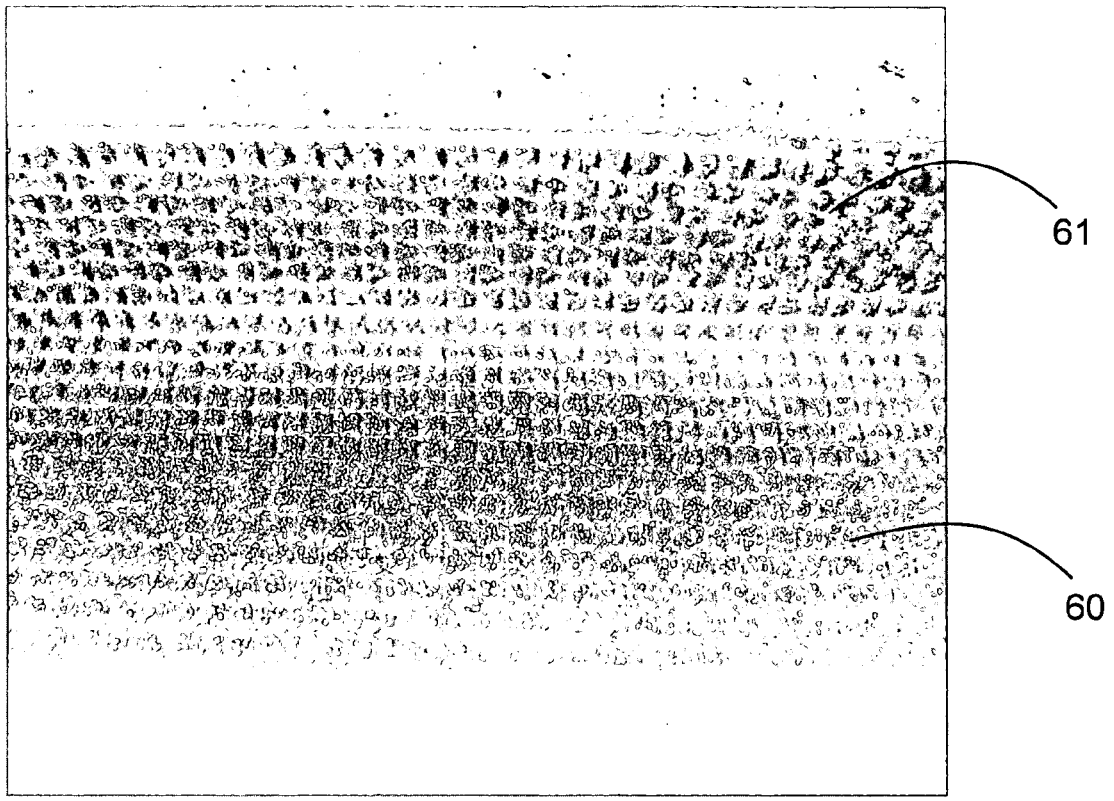
FIG. 6 is a close-up photograph of a coating layer on bottom and side surfaces of a mould cavity, which was coated by a method in accordance with the present invention.
Figure 7A:
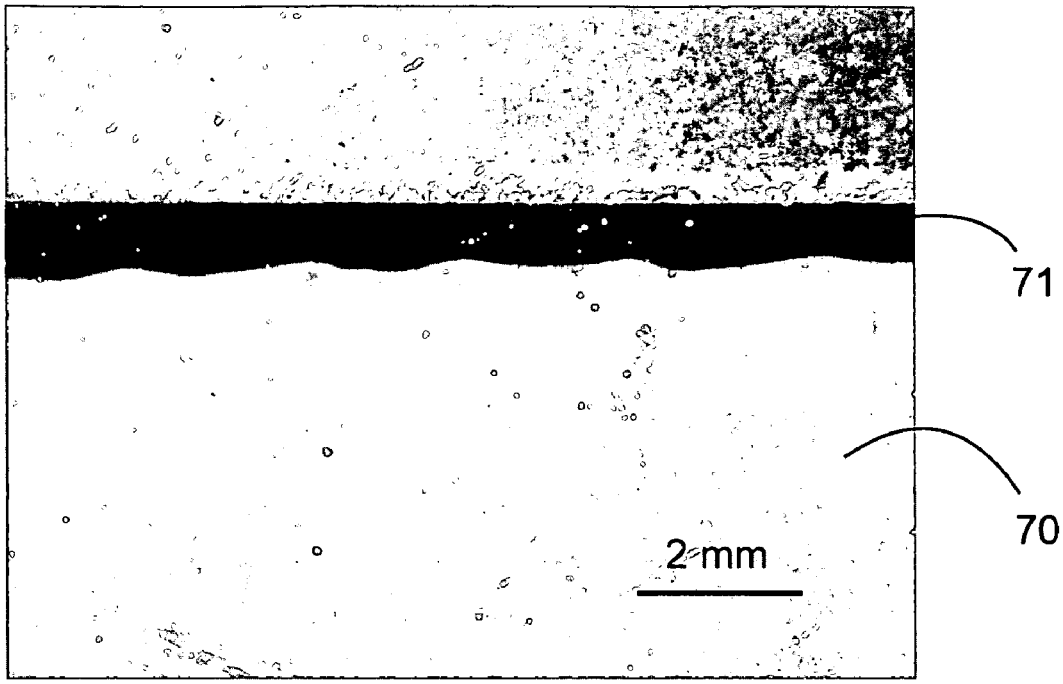
FIG. 7A is a photograph of a P20 tool steel casting having a continuous surface layer of a nickel-based self-fluxing alloy formed thereon by a method of the present invention; and, FIG. 7B is an enlargement of FIG. 7A.
Figure 7B:
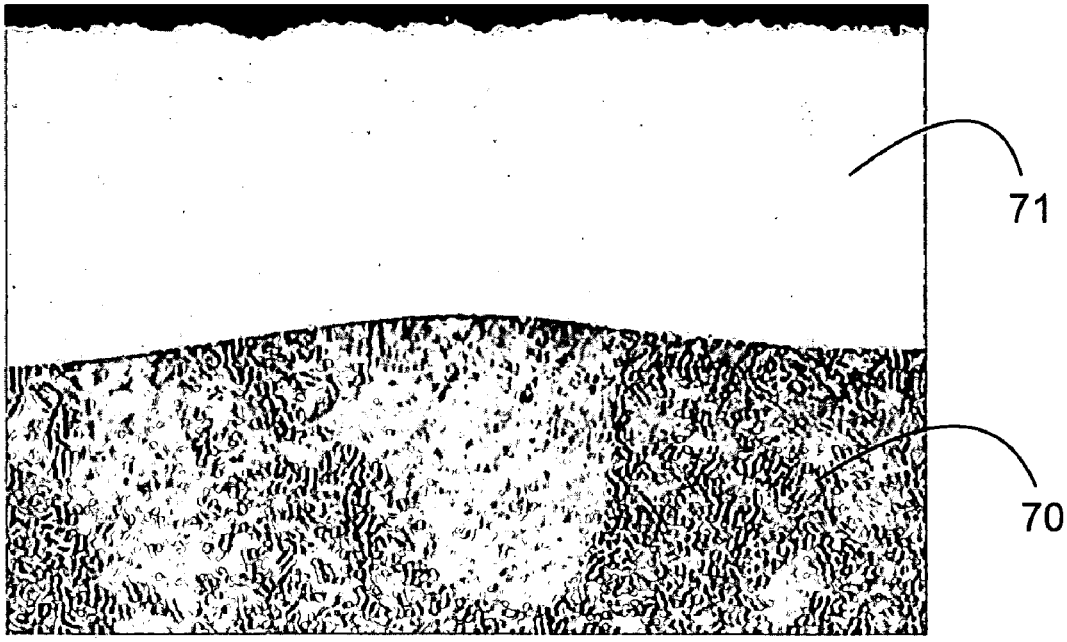

A set of four ceramic casting moulds were fabricated using the process described in Example 1, the casting moulds having mould cavities for rectangular bar-shaped specimens 110 mm long by 30 mm wide with thicknesses of 8 mm, 16 mm, 24 mm and 32 mm, respectively. Steel mesh, as described in Example 1, was used to make masks corresponding to the cavities for each of the ceramic casting moulds. The masks were placed in each mould cavity about 2 mm from the mould cavity surface in each instance. Metco™ 15E nickel-based self-fluxing alloy was applied to each mould cavity surface by flame thermal spray coating under conditions described in Example 1. FIG. 6 shows the coating layer of the Metco™ 15E on the bottom 60 and side 61 surfaces of the mould cavity. P20 tool steel was melted and cast into the closed ceramic casting moulds at 1550° C. In each of the four cases, a continuous surface layer of the Metco™ 15E was alloyed to the surface of the steel casting. FIG. 7A shows one example of a P20 tool steel casting 70 with a continuous alloy layer 71 formed thereon. FIG. 7B is an enlargement of FIG. 7A showing more detail of the interface between the steel casting 70 and the continuous alloy layer 71 formed thereon.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A method of casting, comprising:

(a) providing a casting mould;

(b) placing a mask having a plurality of perforations with the mould to define a masked area of the mould;

(c) spray-coating the masked area of the mould with a coating material to produce a coating layer on the mould that is divided into fragments as a result of spraying the coating material through the mask, the coating material selected for forming a surface layer on the casting;

(d) introducing a liquid casting material to the mould; and, (e) solidifying the liquid casting material to form a surface modified casting.

2. The method according to claim 1, wherein the casting mould is pre-treated to strengthen the mould.

3. The method according to claim 1, wherein the perforated mask is placed with the mould to provide a gap between the mask and the mould of about 1 mm to about 15 mm throughout the masked area.

4. The method according to claim 1, wherein the perforated mask comprises a metal, a metal-coated plastic, a ceramic, or carbon.

5. The method according to claim 1, wherein the perforated mask has a regular pattern of perforations and 2 to 20 openings per 2.5 cm, and wherein the perforations have a regular shape and a shortest axis measuring about 0.5 mm to about 20 mm.

6. The method according to claim 5, wherein the mask is a mesh.

7. The method according to claim 1, further comprising applying an overlay of coating material to the mould without the perforated mask before introducing the liquid casting material to the mould.

8. The method according to claim 1, wherein the spray-coating comprises subsequent passes and a different coating material is applied in one or more of the subsequent passes.

9. The method according to claim 1, wherein the perforated mask is left with the mould when the liquid casting material is intmduced to the mould to thereby form a surface layer incorporating the mask.

10. The method according to claim 1, wherein the casting material is a metal.

11. A method of casting, comprising:

(a) providing a ceramic, sand or metallic casting mould;

(b) placing a mask having a plurality of perforations with the mould to define a masked area of the mould;

(c) thermal spray-coating the masked area of the mould with a coating material to produce a coating layer on the mould that is divided into fragments as a result of spraying the coating material through the mask, the coating material selected for forming a surface layer on the metal casting;

(d) introducing a molten metal to the mould; and, (e) solidifying the molten metal to form a surface modified metal casting.

12. The method according to claim 11, wherein the casting mould is a ceramic casting mould.

13. The method according to claim 11, wherein the casting mould is pre-treated to strengthen the mould.

14. The method according to claim 11, wherein the coating material comprises an Fe-based alloy, a Ni-based alloy, a Co-based alloy, an oxide, a nitride, a boride, a carbide, a mixture of ceramic with a metal, a mixture of cermet with a metal, or a mixture thereof.

15. The method according to claim 11, wherein the perforated mask comprises a metal, a metal-coated plastic, a ceramic, or carbon.

16. The method according to claim 11, wherein the perforated mask comprises a mesh or a perforated plate.

17. The method according to claim 11, wherein the perforated mask is placed with the mould to provide a gap between the mask and the mould of about 1 mm to about 15 mm throughout the masked area.

18. The method according to claim 11, wherein the perforated mask has a regular pattern of perforations and 2 to 20 openings per 2.5 cm, and wherein the perforations have a regular shape and a shortest axis measuring about 0.5 mm to about 20 mm.

19. The method according to claim 18, wherein the perforated mask is a steel mesh.

20. The method according to claim 11, further comprising applying an overlay of coating material to the mould without the perforated mask before introducing the molten metal to the mould.

21. The method according to claim 11. wherein the molten metal is an Fe-based alloy.

22. The method according to claim 11, wherein the molten metal is a steel or cast iron.

23. The method according to claim 11, wherein the thermal spray-coating comprises subsequent passes and a different coating material is applied in one or more of the subsequent passes.

24. The method according to claim 11, wherein the perforated mask is left with the mould when the molten metal is introduced to the mould to thereby form a surface layer incorporating the mask.

* * * * *